US006702601B2

(12) United States Patent
Pogliani

(10) Patent No.: US 6,702,601 B2
(45) Date of Patent: Mar. 9, 2004

(54) CIRCULAR ELECTRICAL CONNECTOR

(75) Inventor: Roberto Pogliani, Cavaglietto (IT)

(73) Assignee: Shield S.r.l., Cavaglietto (IT)

( * ) Notice: Subject to any disclaimer, the term of this patent is extended or adjusted under 35 U.S.C. 154(b) by 0 days.

(21) Appl. No.: 10/187,971

(22) Filed: Jul. 3, 2002

(65) Prior Publication Data

US 2003/0017734 A1 Jan. 23, 2003

(30) Foreign Application Priority Data

Jul. 5, 2001 (IT) ..... MI2001A1427

(51) Int. Cl.[7] ..... H01R 13/62
(52) U.S. Cl. ..... 439/306; 439/281; 439/282
(58) Field of Search ..... 439/281, 282, 439/744, 595, 752, 589, 606

(56) References Cited

U.S. PATENT DOCUMENTS 3,594,696 A 7/1971 Witek, Jr.
4,090,759 A * 5/1978 Herrmann, Jr. ..... 339/60 M
4,688,876 A * 8/1987 Morelli ..... 439/578
4,758,174 A * 7/1988 Michaels et al. ..... 439/281
5,474,465 A 12/1995 Kobayashi
5,595,497 A * 1/1997 Wood ..... 439/282
5,857,877 A * 1/1999 Hotea et al. ..... 439/787

FOREIGN PATENT DOCUMENTS

WO 90/07204 6/1990

* cited by examiner

*Primary Examiner*—Alexander Gilman
(74) *Attorney, Agent, or Firm*—Young & Thompson

(57) ABSTRACT

The electrical connecting device comprises a male connector and a female connector, each provided with a casing and a contact-support body made of electrically insulating material, which can be coupled by means of threaded lock nuts. The contact-supporting body of the female connector, is made of elastomeric material and the female contacts of the connector are elastically yielding and press-fitted into appropriate seats of the contact-support body. The contact-support bodies of female and male connectors also comprise opposite annular sealing shoulder surfaces, designed to rest one against the other in the coupled condition of the two connectors.

3 Claims, 3 Drawing Sheets

CIRCULAR ELECTRICAL CONNECTOR

BACKGROUND OF THE INVENTION

This invention refers to electrical connectors of circular type and, more in particular, is directed to a female electrical connector for low and/or high voltage connecting devices, mainly used for the connection of solenoid valves, pumps, motors, sensors and the like, capable of working under mechanically and electrically stressed conditions.

Both the female and the male connectors can be either of the square or rectilinear type, since each of them is provided with two or more male and female type of electrical contact members, which can be axially coupled together.

STATE OF THE ART

Electrical connectors of the aforementioned kind are widely in use in several fields, and generally comprise a casing made of rubber or other suitable plastic material, over moulded to a contact-supporting body of nylon or any other substantially rigid type of electrically insulating material, in which the seats for housing the electrical contacts are obtained.

A sliding and freely rotating bush of one of the two connectors, externally surrounding the contact-support body, screws onto a ring nut of the other connector, to maintain them in an appropriately coupled condition.

Circular electrical connectors of conventional-type present a number of drawbacks, the main one primarily consists in an insufficient contact pressure between the male and female electrical contacts of the two connectors, which in turn is liable to cause serious difficulties for the electrical equipments to which they are connected, especially at low input current and/or voltage values.

In conventional type connectors it is consequently extremely difficult to guarantee the certainty of the electrical contact, due to the fact that, in order to allow the introduction of the male contact elements, the female contact elements must be able to widen out inside their housing; for this reason the housing must be shaped in such as way as not to create any interference with the radially expansible part of the female electrical contact, which could therefore easily slip out the support-body during the assembling.

There is also the problem of ensuring a satisfactory watertight seal between the two coupled male and female connectors; in this connection, use is normally made of an annular gasket in an appropriate seat, designed to be pressed between facing surfaces of the two connectors.

Even though the use of annular gaskets affords a satisfactory seal, in practice it is difficult to guarantee a uniform sealing pressure around the entire circumference of the connectors, with the consequent risk of moisture or water infiltration at the points where the gasket becomes deformed or is compressed to a lesser degree.

SCOPES OF THE INVENTION

The general scope of this invention is to provide a new and improved electrical connecting device, comprising a male connector and a female connector, which are particularly suitable for remedying the above-mentioned problems.

In particular, one scope of this invention is to provide an electrical contact device as referred to above, which is capable of providing a higher contact pressure between the male and female electrical contact members of the two connectors, thereby eliminating any risk of false contacts, and of such kind as to ensure a satisfactory electrical contact between the two connectors.

A still further scope of this invention is to provide an electrical connecting device as referred to previously, which is capable of ensuring a more efficient watertight seal, and is provided with means capable of preventing an accidental unscrewing of the two coupling ring nuts, under any condition of use of the connectors.

BRIEF DESCRIPTION OF THE INVENTION

More in particular, according to the invention an electrical connecting device has been provided comprising:

- a male connector and a female connector, in which both the connectors comprise
- a casing and a contact-support body of electrically insulating material; and
- in which each of the connectors is provided with an axially sliding and threadable locking nut which can be screwed against annular shoulders of the contact-support bodies, wherein:
  - the contact-support body of the female connector is made of elastomeric material;
  - wherein each electrical contact member of the female connector comprises a conical portion elastically yielding in a radial direction, press-fitted into a seating hole of the contact-support body in elastomeric material of the connection device; and
  - wherein the contact-support bodies of the female and male connectors present opposite annularly shaped shoulder surfaces, designed to be sealingly pressed one against the other in the coupled condition of the electrical connecting device.

BRIEF DESCRIPTION OF THE DRAWINGS

These and further features of the electrical connecting device according to this invention, will be more clearly evident from the following description with reference to the accompanying drawings, in which.

DETAILED DESCRIPTION OF THE INVENTION

Figure 1:
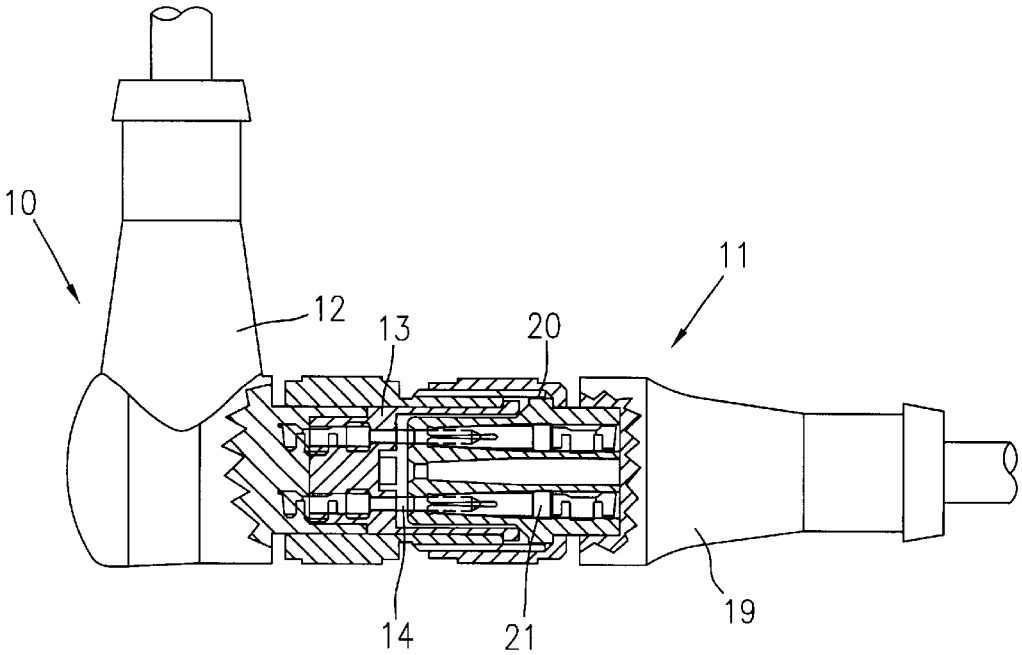
FIG. 1 shows a partial cutaway view of the two connectors coupled together.

The electrical connecting device shown in FIG. 1, comprises a first male connector 10 for example of the square type, and a second female connector 11 for example of the linear type.

The male connector 10 in turn comprises a casing 12 made of rubber or other suitable plastic material, which is over-moulded to a contact-support body 13 made of rigid plastic material, for example made of nylon; the body 13 comprises a plurality of contact pins 14 each designed to fit axially into a corresponding female contact member on the other connector 11, as explained further on.

Figure 2:
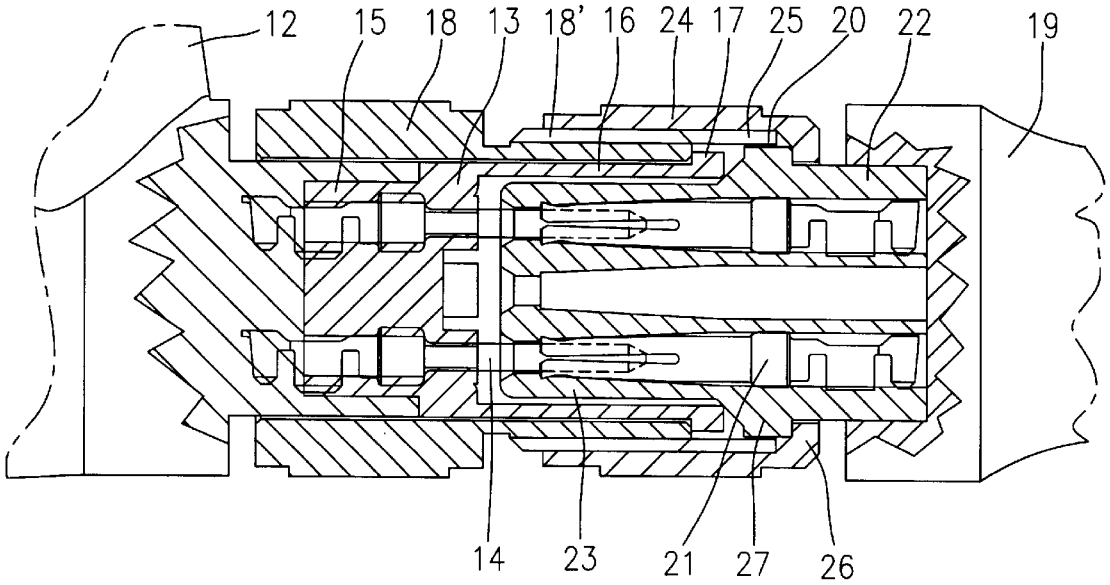
FIG. 2 shows an enlarged detail of FIG. 1.

As can be more clearly seen from the enlarged view of FIG. 2, the male contact-support body 13 is provided with a cylindrical shank 15 for connection with the casing 12, which contains the seat holes for the insertion of the contact pins 14.

The contact-support body 13 extends into a cylindrical wall 16 provided at its fore end with an annular shoulder 17 having an internal rim 17'.

A ring nut 18 provided with an external thread 18', axially slides and freely rotates on the cylindrical portion of the casing 12 and of the contact-support body 16.

The female connector 11 in turn comprises a casing 19 made of rubber or other suitable plastic material, over moulded to a contact-support body 20 provided with a plurality of female contact members 21 fitted into appropriate seating holes, to receive the contact pins 14 of the male connector 10.

More precisely, the contact-support body 20 of the female connector is provided with a shank 22 for connection with the casing 19 of the connector; the shank 22 extends forwards into a cylindrical portion 23 designed to penetrate into the cylindrical wall 16 of the contact-support body 13 of the male connector 10.

The contact-support body 20 of the female connector 11 in turn is provided with a ring nut 24 having an internal thread 25 designed to couple with the external thread 18' of the ring nut 18.

At its rear end, the ring nut 24 also comprises an inwardly-folded rim 26, which is designed to come into contact with an annular shoulder 27 of the contact-support body 20, between the rear shank 22 and the fore cylindrical portion 23.

Figure 3:
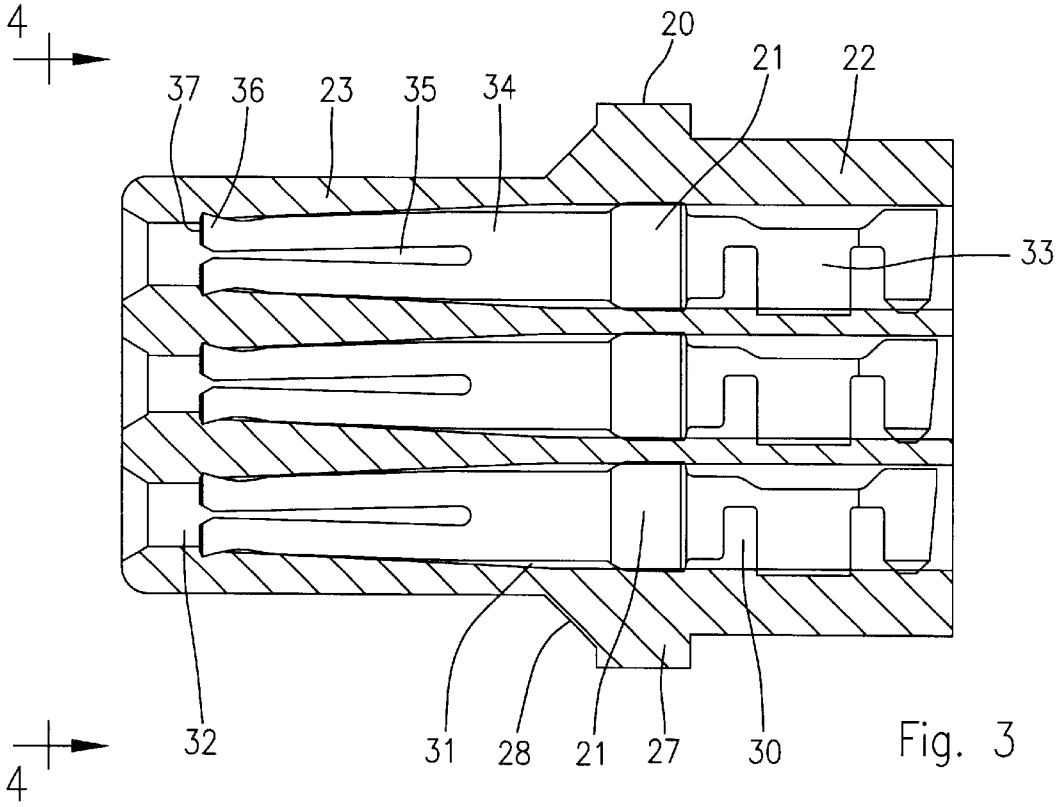
FIG. 3 shows an enlarged detail of the contact-supporting body of the female connector, along the line 3—3 of FIG. 4.
Figure 4:
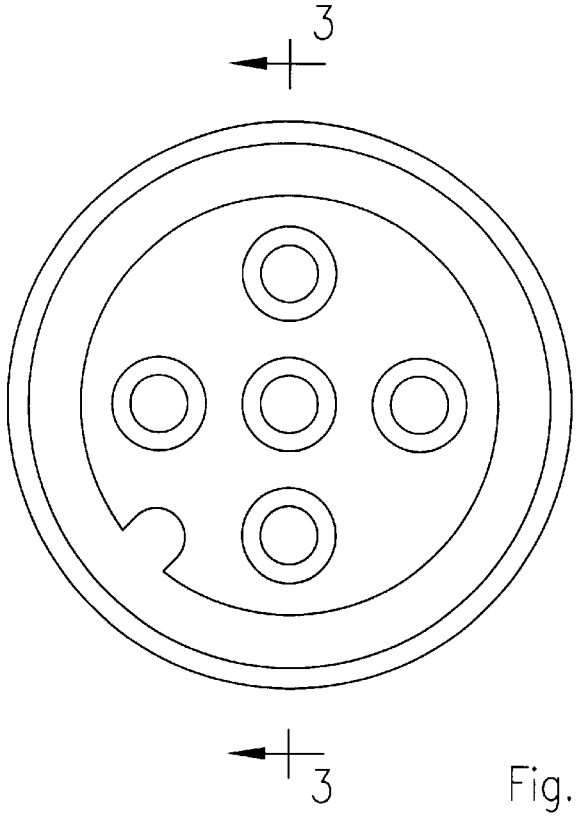
FIG. 4 shows a view along the line 4—4 of FIG. 3.
Figure 5:
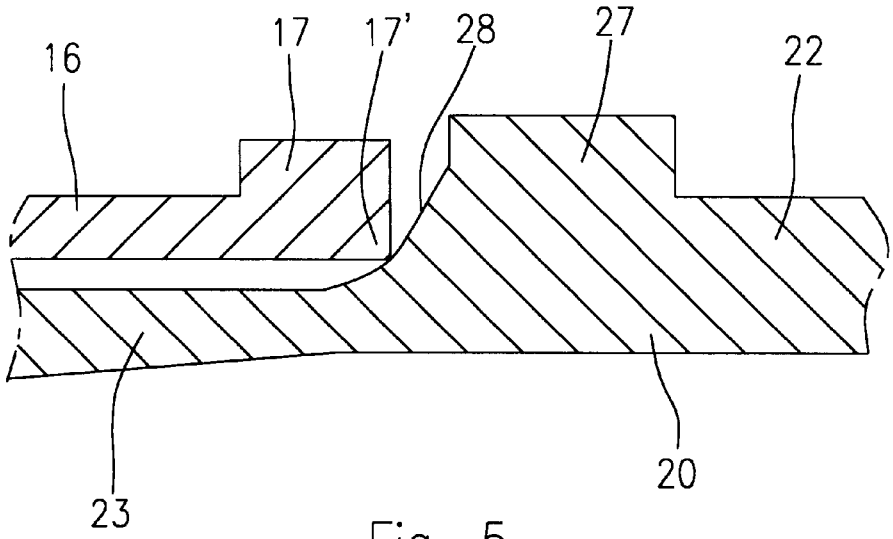
FIG. 5 shows a more highly magnified enlarged detail of FIG. 2.

As shown in FIG. 3 and in the enlarged detail of FIG. 5, the shoulder 27 of the female contact-support body fits onto the cylindrical portion 23 by means of a slanted surface 28, for example forming an angle of 45° with the longitudinal axis of the connector; the surface 28 is designed to come into contact and to form a seal with an opposite surface of the cylindrical wall 16 of the contact-support body 13 of the male connector, for example consisting of the internal corner 17' at the fore end of the annular shoulder 17.

In this connection, in conformity with this invention, the contact-support body 20 is made of elastically yielding elastomeric material, to provide a high sealing pressure when the corner 17' of the shoulder 17, during the screwing of the ring nuts 18 and 24 of the two connectors, comes into contact with and is pressed against the slanting surface 28 of the female contact-support body 22.

For these and other scopes of this invention, it is therefore essential for the entire female contact-support body to be made of an elastomeric material which is capable of yielding elastically, both for the fitting and radial expansion of the female contacts 21, as explained further on, and for the necessary watertight seal when the two connectors are coupled together.

Any plastic material, having appropriate elastomeric properties, can be used for the female contact-support body 20; for example, it is possible to use a thermoplastic elastomeric polyurethane (PUR), such as a polyester-polycaprolactone-based thermoplastic material, or a combination of diphenylmethane diisocyanate (MDI) and a polyester or a polyester-based polyol.

Excellent results have been obtained using an elastomeric polyurethane material having a hardness ranging from 92 to 96 Shore A, with a modulus of elasticity ranging from 8.2 to 8.6 MPa at an elongation equivalent to 50%.

Since, as it is being tightened, the ring nut 18 of the male connector pushes against the shoulder 17 of the rigid wall 16 of the body supporting the fixed contacts, while the ring nut 24 with its rim 26 pushes against the opposite side of the shoulder 27 of the support body 20 for the female contacts, made of elastically yielding elastomeric material, it is obvious that by tightening the two ring nuts 18 e 24 more or less it is also possible to vary the contact pressure between the sealing surfaces 17' and 28, thereby obtaining an even pressure over the entire peripheral surfaces of the two connectors.

Moreover, the elastic behaviour of the body 20 made of elastomeric material, supporting the female contacts, exerts a sufficient axial force on the threads 19 and 25 of the two ring nuts to prevent them from becoming accidentally unscrewed.

According to a further feature of the invention, as shown in greater detail in FIG. 3 of the accompanying drawings, the female contact-support body 20, for each contact 21 is provided with a seat consisting of a through hole which comprises a cylindrical rear portion 30, and a conical intermediate portion 31 which continues into a cylindrical fore portion 32 of smaller diameter, designed to allow the penetration or press-fitting of a contact pin of the male connector.

Each female contact 21 in turn is provided with a rear portion 33 designed to be clamped to an electrical conductor, which partially protrudes from the rear portion 30 of the housing hole, and also comprises a conical fore portion 34 which adapts to the internal tapering of the intermediate portion 31 of the housing hole.

The fore portion 34 of each female contact is made elastically yielding in a radial direction by a longitudinal slit 35, and ends at its fore end with a diverging portion 36 designed to engage, or press-fitted with a certain degree of interference, into the fore end of the conical hole 31, and coming to rest against an internal annular shoulder 37.

In this way various substantially advantages are achieved, the first of these being that of facilitating an easy elastic splay at the fore end 34 of the female contact member 34, upon the insertion of a male contact pin 14, thanks to the elastic yielding of the elastomeric material with which the contact-support body 20 of the female connector is made.

By means of the slightly forced insertion of each female contact 21, into its respective housing seat in the contact-support body 20, and thanks to the elastic properties of the latter, it is also possible to achieve the further advantage of firmly retaining the contact 21, once it has been inserted or press-fitted into its housing, during the assembling of the connector and moulding the outer casing, as well as the advantage of utilising the elasticity of the contact-support body itself to reduce the fatigue stress to which the female contacts are usually subjected during use.

Figure 6:
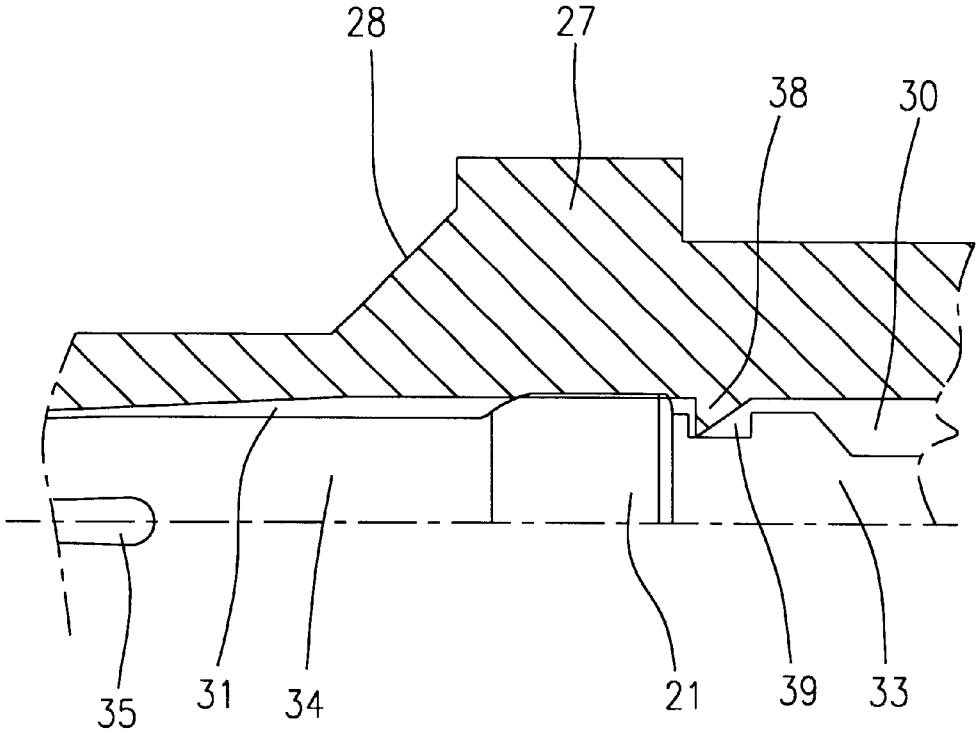
FIG. 6 shows a further enlarged detail of FIG. 3.

As shown in the detail of FIG. 6, each hole housing the female contacts 21, can be provided on the rear portion 30 with a detent 38 designed to snap, due to the elasticity of the material, into a slot 39 made on one edge of the rear portion 33, designed to be clamped onto an electrical conductor, thereby preventing the female contact 21 from accidentally slipping out of its housing during assembling, regardless of the press-fitting degree of the contact itself into the elastomeric material of the contact-support body.

From what has been shown in the accompanying drawings, it will be clear that what is provided is an electrical connecting device having a male connector and a female connector, in which the female connector is characterised by comprising a contact-support body of elastomeric material, and by comprising means for retaining each female contact element, which exploit the elasticity of the elastomeric material itself to prevent the female contact element from accidentally slipping out during the assembling of the connector, as well as to allow a radial expansion of the same female contact element to providing good contact conditions for both connectors.

It is understood however that what has been described and shown in the accompanying drawings has been given purely by way of example in order to illustrate this invention, and that other modifications may be made, without deviating from the scope of the accompanying claims.

I claim:

1. An electrical connector assembly comprising:

a male connector and a female connector provided with electrical contact members;

the male connector having a contact support body in rigid material provided with a cylindrical wall;

the female connector having a cylindrical contact support body in elastomeric material to be introduced into the cylindrical wall of the male contact support body, the electrical contact members of the female connector having an elastically yielding conical portion press-fitted into a conical hole of said outer sealing means on the contact support bodies, said outer sealing means comprising an annular shoulder having a corner peripheral edge at the front end of the cylindrical wall of the male contact support body, and a conical surface on the female contact support body, facing said corner edge; and connector locking means comprising screwable ring nut members on the male and female contact support bodies, said ring nut members being constructed and arranged on the contact support members to axially urge the corner edge of the annular shoulder in rigid material, against the conical surface in elastomeric material, in the assembled condition of the connector assembly.

2. The electrical connector assembly according to claim 1, wherein the ring nut member of the female connector comprises an annular shoulder frictionally engaging with a facing annular shoulder of the female contact support body in elastomeric material, in the assembled condition of the connector assembly.

3. The electrical connector assembly according to claim 1, wherein the female contact member comprises a divergent fore portion resting against a shoulder at the fore end of the conical hole.

* * * * *